US010975316B2

(12) United States Patent
Van Willigenburg

(10) Patent No.: US 10,975,316 B2
(45) Date of Patent: Apr. 13, 2021

(54) PROCESS AND A SYSTEM FOR GENERATING HYDROCARBON VAPOR

(71) Applicant: SABIC GLOBAL TECHNOLOGIES B.V., Bergen op Zoom (NL)

(72) Inventor: Joris Van Willigenburg, Geleen (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/339,628

(22) PCT Filed: Oct. 4, 2017

(86) PCT No.: PCT/IB2017/056129

§ 371 (c)(1),
(2) Date: Apr. 4, 2019

(87) PCT Pub. No.: WO2018/065922

PCT Pub. Date: Apr. 12, 2018

(65) Prior Publication Data

US 2019/0241819 A1 Aug. 8, 2019

(30) Foreign Application Priority Data

Oct. 7, 2016 (EP) ..... 16192721

(51) Int. Cl.
*C10G 7/00* (2006.01)
*C10G 9/36* (2006.01)
*C10G 31/06* (2006.01)

(52) U.S. Cl.
CPC ..... *C10G 31/06* (2013.01); *C10G 7/00* (2013.01); *C10G 9/36* (2013.01)

(58) Field of Classification Search
None
See application file for complete search history.

(56) References Cited

U.S. PATENT DOCUMENTS 1,877,811 A 9/1932 Coleman
2,745,794 A 5/1956 Alozery et al.
(Continued)

FOREIGN PATENT DOCUMENTS

CN 101528894 9/2009
WO WO 2008/131330 10/2008
(Continued)

OTHER PUBLICATIONS

European Search Report issued in corresponding European Patent Application No. 16192721, dated Mar. 24, 2017.
(Continued)

*Primary Examiner* — Tam M Nguyen
(74) *Attorney, Agent, or Firm* — Norton Rose Fulbright US LLP

(57) ABSTRACT

A process for vaporizing hydrocarbon feedstock comprising pressurizing the hydrocarbon feedstock using a hydrocarbon feedstock pump, preheating the hydrocarbon feedstock in a first heat exchanger and distilling the preheated hydrocarbon feedstock in a medium pressure distillation column connected to the first heat exchanger, and wherein the medium pressure distillation column is operated at a pressure in a range of 0.7 to 1.2 MPa. A system for producing hydrocarbon vapor, comprising a hydrocarbon feedstock pump for pressurizing hydrocarbon feedstock, a first heat exchanger connected to the hydrocarbon feedstock pump, and a medium pressure distillation column connected to the heat exchanger for distilling the heated hydrocarbon feedstock at medium pressure in a range of 0.7 to 1.2 MPa.

10 Claims, 2 Drawing Sheets

(56) References Cited

U.S. PATENT DOCUMENTS

| | | | |
|---|---|---|---|
| 3,886,062 | A | 5/1975 | Peiser et al. |
| 4,673,490 | A | 6/1987 | Subramanian et al. |
| 6,153,087 | A | 11/2000 | Bigeard et al. |
| 6,270,654 | B1 | 8/2001 | Colyar et al. |
| 7,214,308 | B2 | 5/2007 | Colyar |
| 7,404,889 | B1 | 7/2008 | Powers |
| 7,704,377 | B2 | 4/2010 | Duddy et al. |
| 7,938,952 | B2 | 5/2011 | Colyar et al. |
| 8,926,824 | B2 | 1/2015 | Morel |
| 9,005,430 | B2 | 4/2015 | Fournier et al. |
| 9,840,674 | B2 | 12/2017 | Weiss et al. |
| 2008/0093261 | A1 | 4/2008 | Powers |
| 2008/0093262 | A1 | 4/2008 | Gragnani et al. |
| 2009/0048475 | A1 | 2/2009 | Powers |
| 2014/0299515 | A1 | 10/2014 | Weiss et al. |
| 2016/0097002 | A1 | 4/2016 | Sundaram |
| 2016/0122666 | A1 | 5/2016 | Weiss et al. |

FOREIGN PATENT DOCUMENTS

| | | |
|---|---|---|
| WO | WO 2015/128034 | 9/2015 |
| WO | WO 2016/146326 | 9/2016 |

OTHER PUBLICATIONS

European Search Report issued in Corresponding European Patent Application No. 16192716, dated Mar. 21, 2017.

International Search Report and Written Opinion issued in International Patent Application No. PCT/IB2017/056129, dated Jan. 17, 2018.

International Search Report and Written Opinion issued in International Patent Application No. PCT/IB2017/056124, dated Jan. 17, 2018.

Zimmerman & Walzl, "Ethylene" *Ullman's Encycolopedia of Industrial Chemistry*, 2012, vol. 13, pp. 465-529.

Search Report and Written Opinion issued in corresponding Singaporean Patent Application No. 11201902674T, dated May 14, 2020 (8 pages).

Office Action issued in counterpart Chinese Patent Application No. 201780062036.4, dated Dec. 15, 2020.

Wang Lei, "Brief Introduction of Lubricant and Its Production Process," *Liaoning Science and Technology Press*, 2014 (English translation provided).

PROCESS AND A SYSTEM FOR GENERATING HYDROCARBON VAPOR

CROSS-REFERENCE TO RELATED APPLICATIONS

This application is a national phase under 35 U.S.C. § 371 of International Application No. PCT/IB2017/056129, filed Oct. 4, 2017, which claims the benefit of priority of European Patent Application No. 16192721.5 filed Oct. 7, 2016, the entire contents of each of which are hereby incorporated by reference in their entirety.

FIELD OF THE INVENTION

The invention relates to a process and a system for generating hydrocarbon vapor.

BACKGROUND

After crude oil has been distilled and fractionated in a crude oil distillation unit, the naphtha fraction containing a mixture of various hydrocarbons can be used as a hydrocarbon feedstock for the production of various derivative products. Such derivatives can be produced in processes known as, for example, steam cracking and continuous catalytic reforming.

Steam cracking is a petrochemical process wherein saturated hydrocarbons having long molecular structures are broken down into smaller saturated or unsaturated molecules.

Steam cracking, also referred to as pyrolysis, has long been used to crack various hydrocarbon feedstocks into olefins, preferably light olefins such as ethylene, propylene, and butylenes. Conventional steam cracking utilizes a pyrolysis furnace which has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place.

The stream then enters a fired tubular reactor (radiant tube or radiant coil) where, under controlled residence time, temperature profile, and partial pressure, it is normally heated from 500-650° C. to 750-875° C. for a duration normally in a range of 0.1-0.5 s. During this short reaction time hydrocarbons in the feedstock are cracked into smaller molecules; ethylene, other olefins, and diolefins are the major products. Since the conversion of saturated hydrocarbons to olefins in the radiant tube is highly endothermic, high energy input rates are needed. The reaction products leaving the radiant tube at 800-850° C. can be cooled to 550-650° C. within 0.02-0.1 s to prevent degradation of the highly reactive products by secondary reactions. The resulting products, including olefins, leave the pyrolysis furnace for further downstream processing, including quenching.

The resulting product mixtures, which can vary widely, depending on feedstock and severity of the cracking operation, are then separated into the desired products by using a complex sequence of separation and chemical-treatment steps. The cooling of the cracked gas is performed in a transfer line exchanger by vaporization of high-pressure boiler feed water (BFW, 6-12 MPa), which is separated in the steam drum and subsequently superheated in the convection section to high-pressure superheated steam (VHP), 5-12 MPa).

Steam cracking is an energy intensive petrochemical process. The cracking furnaces are the largest fuel consumers in a steam cracking plant. In the case of a steam cracker cracking a liquid hydrocarbon feedstock, such as naphtha, about 10% of the heat released in the furnace is used for preheating and evaporating the feed.

Continuous Catalytic Reformers (CCR) transform hydrocarbon feedstock distilled from crude oil into so called reformates. These comprise aromatic hydrocarbons such as benzene, toluene and xylene.

Both steam cracking and CCR have in common that they transform hydrocarbon vapor or naphtha vapor into other compounds.

The hydrocarbon feedstock is originating from upstream refinery processes such as an atmospheric distillation tower, hydrocracker, FCC, coker, resid hydrocracker. These processes are or contain fractionating processes that at one stage have the naphtha as a vapor stream. The mentioned fractionating processes typically employ steam that comes as vapor with the naphtha fraction and needs to be separated out to have an on-spec naphtha.

However, these fractionating processes operate at near ambient pressures, while for the naphtha vapor in a steam cracking furnace at pressure of approximately 0.6-0.8 MPa is required to overcome the pressure drop over the remaining convection banks, cracking coils, etc.

It is also not just possible to raise the pressure of these fractionating processes, since this will influence the separation or/and requires a higher temperature at the bottom, which will result in undesired thermal cracking of the hydrocarbons in the fractionating process.

OBJECTS OF THE INVENTION

It is an object of the invention to produce hydrocarbon feedstock vapor at sufficient pressure for use in chemical derivative production.

SUMMARY OF THE INVENTION

The object is achieved in a process for vaporizing hydrocarbon feedstock comprising pressurizing the hydrocarbon feedstock using a hydrocarbon feedstock pump, preheating the hydrocarbon feedstock in a first heat exchanger and distilling the preheated hydrocarbon feedstock in a medium pressure distillation column connected to the first heat exchanger, and wherein the medium pressure distillation column is operated at a pressure in a range of 0.7 to 1.2 MPa.

The heat exchanger and a medium pressure distillation column connected to the heat exchanger can be used for separation of lighter components, i.e. naphtha, from hydrocarbon feedstock which in this case comprises crude oil. This allows the pressurized naphtha vapor to be separated from the hydrocarbon feedstock, which can for example be advantageously used in conversion processes wherein the hydrocarbon feedstock vapor is transformed into derivative products. An example of such a process is steam cracking which is performed in a steam cracker furnace, which in the art is arranged for vaporizing the hydrocarbon feedstock. Supplying hydrocarbon feedstock vapor externally of the steam cracking furnace makes a vaporizing convection bank in the steam cracking furnace superfluous. This leaves for example more steam cracker furnace capacity for producing superheated very high pressure steam. In another example, supplying hydrocarbon feedstock vapor to a continuous catalytic reforming process also allows for more energy efficient production of the derivative products in such a process.

In the indicated pressure range the hydrocarbon feedstock or naphtha leaves the column as a vaporized hydrocarbon feedstock with sufficient pressure for use in the conversion processes as described.

In an embodiment, the process further comprises distilling the hydrocarbon feedstock in the medium pressure distillation column using medium pressure stripping steam having an absolute pressure in a range of 0.8-2.0 MPa.

This provides low grade energy for performing the distillation.

In an embodiment, the medium pressure steam has a temperature in a range of 180-350° C. This temperature range corresponds to the pressure range indicated for the medium pressure stripping steam.

In an embodiment, the first heat exchanger is heated using a heat transfer medium having a temperature in a range of 160-350° C. The heat for the first heat exchanger can be obtained from various sources, such as medium pressure steam, medium pressure stripping steam, quench oil, etcetera. This also applies to heating the medium pressure distillation column, which can be heated in similar ways.

In an embodiment, the process further comprises preheating the hydrocarbon feedstock through heat exchange in a second heat exchanger, and distilling the hydrocarbon stream in a low pressure distillation column into at least one of a light distillate fraction and a middle distillate fraction and a heavy distillate fraction using a second heat transfer medium, wherein the low pressure distillation column is operated at an absolute pressure in a range of 0.1-0.6 MPa.

In an embodiment, the process further comprises distilling the hydrocarbon stream in a low pressure distillation column (C-302) using low pressure stripping steam having an absolute pressure in a range of 0.1-0.7 MPa.

In an embodiment, the process further comprises recycling gas components from the low pressure distillation column to the medium pressure distillation column.

This allows further separation of hydrocarbon vapor components and liquid components, thus allowing enhanced hydrocarbon feedstock vapor production for conversion processes.

The object of the invention is also achieved in a system for producing hydrocarbon vapor, comprising a hydrocarbon feedstock pump for pressurizing hydrocarbon feedstock, a first heat exchanger connected to the hydrocarbon feedstock pump, and a medium pressure distillation column connected to the heat exchanger for distilling the heated hydrocarbon feedstock at medium pressure in a range of 0.7 to 1.2 MPa.

In an embodiment, the medium pressure distillation column has an inlet for supplying medium pressure stripping steam, wherein the medium pressure stripping steam has an absolute pressure in a range of 0.8-2.0 MPa.

In an embodiment, the medium pressure stripping steam has a temperature in a range of 180-350° C.

In an embodiment, the first heat exchanger is heated using a heat transfer medium having a temperature in a range of 160-350° C.

In an embodiment, the system further comprises a second heat exchanger connected to the medium pressure distillation column for preheating the hydrocarbon feedstock through heat exchange, and a low pressure distillation column connected to the second heat exchanger for distilling the hydrocarbon stream into at least one of a light distillate fraction and a middle distillate fraction and a heavy distillate fraction, wherein the low pressure distillation column is arranged to operate at an absolute pressure in a range of 0.1-0.6 MPa.

In an embodiment, the low pressure distillation column has an inlet for low pressure stripping steam having an absolute pressure in a range of 0.1-0.7 MPa.

In an embodiment, the system has a recycle path from the low pressure distillation column to the medium pressure distillation column for recycling back condensed components from the low pressure distillation column.

The following includes definitions of various terms and phrases used throughout this specification.

The terms "about" or "approximately" are defined as being close to as understood by one of ordinary skill in the art. In one non-limiting embodiment, the terms are defined to be within 10%, preferably, within 5%, more preferably, within 1%, and most preferably, within 0.5%.

The terms "wt. %", "vol. %", or "mol. %" refers to a weight, volume, or molar percentage of a component, respectively, based on the total weight, the total volume, or the total moles of material that includes the component. In a non-limiting example, 10 moles of component in 100 moles of the material is 10 mol. % of component.

The term "effective," as that term is used in the specification and/or claims, means adequate to accomplish a desired, expected, or intended result.

The use of the words "a" or "an" when used in conjunction with the term "comprising" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include"), or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, steps etc., disclosed throughout the specification. It is also to be understood that a description on a product/composition/process/system comprising certain components also discloses a product/composition/system consisting of these components. The product/composition/process/system consisting of these components may be advantageous e.g., in that it offers a simpler, more economical process for the preparation of the product/composition. Similarly, it is also to be understood that, for example, a description on a process comprising certain steps also discloses a process consisting of these steps. The process consisting of these steps may be advantageous in that it offers a simpler, more economical process.

When values are mentioned for a lower limit and an upper limit for a parameter, ranges made by the combinations of the values of the lower limit and the values of the upper limit are also understood to be disclosed.

In the context of the present invention, 14 Embodiments are now described. Embodiment 1 is a process for producing hydrocarbon feedstock vapor including the steps of pressurizing hydrocarbon feedstock using a hydrocarbon feedstock pump; preheating the pressurized hydrocarbon feedstock in a first heat exchanger; and distilling the preheated hydrocarbon feedstock in a medium pressure distillation column connected to the first heat exchanger, and wherein the medium pressure distillation column is operated at an absolute pressure in a range of 0.7 to 1.2 MPa. Embodiment 2 is the process according to embodiment 1, further comprising distilling the hydrocarbon feedstock in the medium pressure distillation column using medium pressure stripping steam having an absolute pressure in a range of 0.8-2.0 MPa. Embodiment 3 is the process according to embodiments 1 or 2, wherein the medium pressure stripping steam has a temperature in a range of 180-350° C. Embodiment 4 is the process according to any of embodiments 1 to 3, wherein the heat exchanger is heated using a heat transfer medium having a temperature in a range of 160-350° C. Embodiment 5 is the process according to any of embodiments 1 to 4, further including the steps of preheating fluid components of the hydrocarbon feedstock from the medium pressure distillation column through heat exchange in a second heat exchanger, and distilling the hydrocarbon feedstock in a low pressure distillation column into at least one of a light distillate fraction and a middle distillate fraction and a heavy distillate fraction, wherein the low pressure distillation column is arranged to operate at atmospheric pressure. Embodiment 6 is the process according to embodiment 5, further comprising distilling the hydrocarbon stream in a low pressure distillation column using low pressure stripping steam having an absolute pressure in a range of 0.1-0.7 MPa. Embodiment 7 is the process according to at least one of embodiments 5 or 6, further comprising recycling condensed components of the distillated hydrocarbon feedstock from the low pressure distillation column to the medium pressure distillation column.

Embodiment 8 is a system for producing hydrocarbon vapor, including a hydrocarbon feedstock pump for pressurizing hydrocarbon feedstock; a first heat exchanger connected to the hydrocarbon feedstock pump, and a medium pressure distillation column connected to the heat exchanger for distilling the heated hydrocarbon feedstock at medium pressure in a range of 0.7 to 1.2 MPa. Embodiment 9 is a system according to embodiment 8, wherein the medium pressure distillation column has an inlet for supplying medium pressure stripping steam, wherein the medium pressure stripping steam has an absolute pressure in a range of 0.8-2.0 MPa. Embodiment 10 is the system according to embodiments 8 or 9, wherein the medium pressure stripping steam has a temperature in a range of 180-350° C. Embodiment 11 is the system according to any of the embodiments 8 to 10, wherein the first heat exchanger is heated using a heat transfer medium having a temperature in a range of 160-350° C. Embodiment 12 is the system according to any of the embodiments 8 to 11, further including a second heat exchanger connected to the medium pressure distillation column for preheating liquid components of the hydrocarbon feedstock from the medium pressure distillation column; and a low pressure distillation column connected to the second heat exchanger for distilling the hydrocarbon feedstock into at least one of a light distillate fraction and a middle distillate fraction and a heavy distillate fraction; wherein the low pressure distillation column is arranged to operate at atmospheric pressure. Embodiment 13 is the system according to embodiment 12, wherein the low pressure distillation column has an inlet for low pressure stripping steam having an absolute pressure in a range of 0.1-0.7 MPa. Embodiment 14 is the system according to at least one of embodiments 12 or 13, further including a recycle path from the low pressure distillation column to the medium pressure distillation column.

Other objects, features and advantages of the present invention will become apparent from the following figures, detailed description, and examples. It is noted that the invention relates to all possible combinations of features described herein, preferred in particular are those combinations of features that are present in the claims. It will therefore be appreciated that all combinations of features relating to the composition, process, system according to the invention; all combinations of features relating to the process according to the invention and all combinations of features relating to the system according to the invention and features relating to the process according to the invention are described herein. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

DETAILED DESCRIPTION OF EMBODIMENTS

Naphtha as hydrocarbon feedstock can be vaporized and supplied to a conversion process such as steam cracking furnace, a Continuous Catalytic Reformer (CCR) or any other process converting naphtha vapor into components at pressures in a range of 0.6-0.8 Pa as described below.

Figure 1:
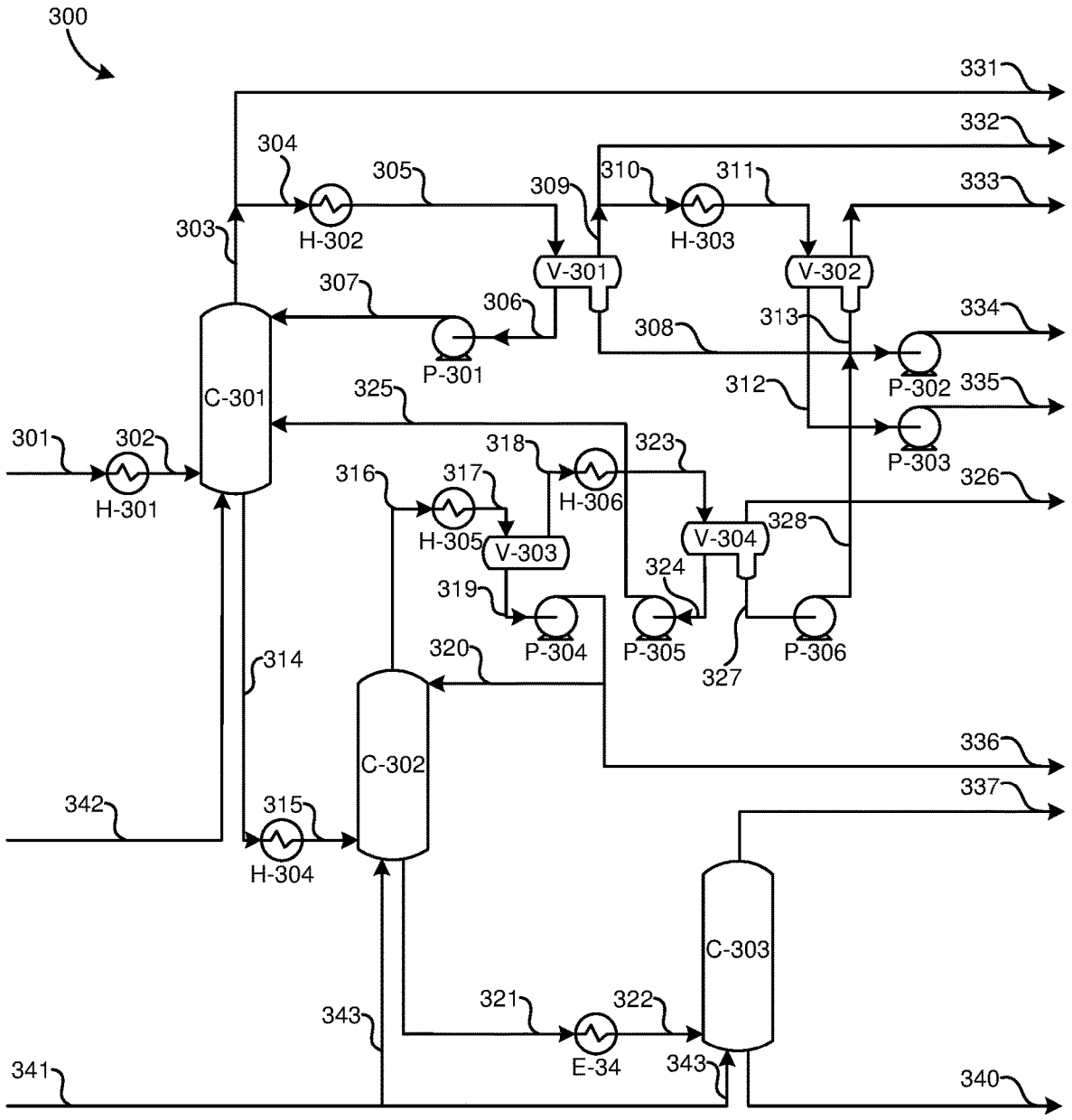
FIG. 1 shows a schematic diagram of a process and system for producing a vapor hydrocarbon feedstock product from a crude hydrocarbon feedstock stream.
Figure 2:
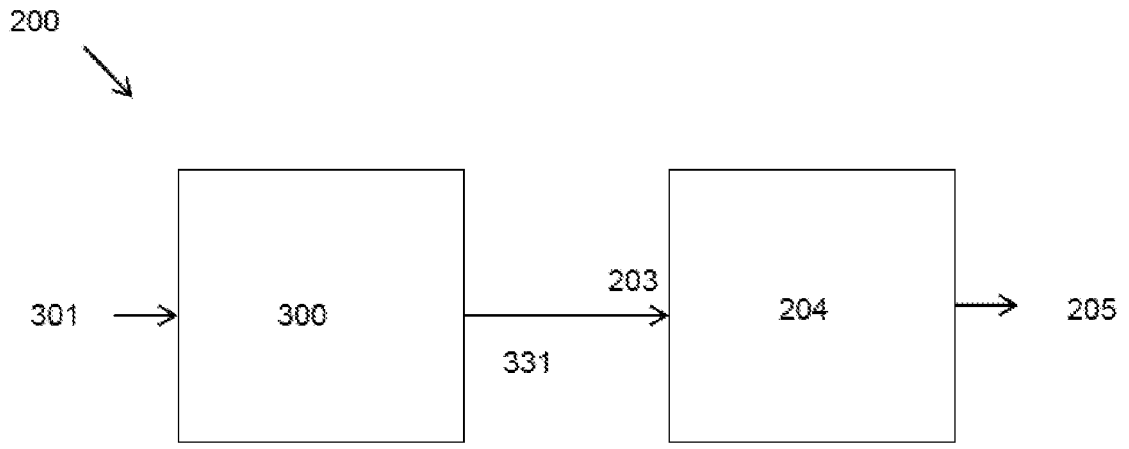
FIG. 2 shows an application of the process and for producing a vapor hydrocarbon feedstock product according to an embodiment of the invention.

FIG. 1 shows a refinery process 300 which is capable of providing hydrocarbon feedstock vapor, i.e. naphtha, from crude hydrocarbon feedstock such as crude oil, a hydrocracker product, a catalytic cracker product or a coker product to the steam cracking furnace of FIG. 2 at a sufficiently high temperature and pressure.

In this preferred solution the refinery units providing hydrocarbon feedstock to the conversion process produce their products at sufficient pressure to be mixed with stream 202 independent from the conversion process and deliver these to the UMP (FIG. 2) directly. The hydrocarbon fractionating system of these refinery units should be properly designed for that to do so efficiently. An example for the crude hydrocarbon feedstock distiller is provided by FIG. 3.

Crude hydrocarbon feedstock is desalted, and preheated as is typical for the state of the art crude distillers (including extended preheating against products) to stream 301, this stream is pumped at medium pressure using a crude hydrocarbon feedstock pump to heat exchanger H-301, and is further heated in heat exchanger H-301 to a temperature in the range of 220-350° C. in stream 302 depending on the composition of the crude oil, desired cut point of the naphtha to the steam cracker and the pressure of the column that is governed by the requirements of the steam cracker furnace. The heat exchanger H-301 can be a furnace, a steam heater or any other type of heater, heated by any suitable heat source such as for example medium pressure steam or quench oil from the steam cracking furnace which is normally available at a temperature of around 160° C. The medium pressure (MP) steam normally has an absolute pressure in a range of 0.8-2.0 MPa.

The preheated hydrocarbon feedstock stream 302 is sent to a medium pressure distillation column C-301, operated at an absolute pressure in the range of 0.7 to 1.2 MPa. Its pressure is mainly governed by the vapor naphtha pressure required by the steam cracker and the pressure drop in the transport line. The pressure at which the crude hydrocarbon feedstock is pumped to the heat exchanger H-301 must be sufficient to overcome the pressure drop in the heat exchanger and to obtain the required pressure in the medium pressure distillation column C-301 in the range of 0.7 to 1.2 MPa. This pumping pressure may vary depending on the heat exchanger type.

The crude hydrocarbon feedstock in distillation column C-301 can be heated using further heat exchangers, reboilers or stripping steam. Medium pressure stripping steam 342 can be added to the crude hydrocarbon feedstock in a temperature range of 180-350° C., at the bottom of this medium pressure distillation column C-301. A liquid hydrocarbon feedstock stream 325 from an atmospheric distillation column C-302, can be added from a subsequent stage, i.e. distillation column C-302 as will be described below.

At the bottom 314 of medium pressure distillation column C-301 a product is taken containing mainly middle distillates and heavier fractions of the crude oil in stream 314. At the top the naphtha and lighter components, included in the stream 303 are taken. Part 304 of this stream 303 is condensed in heat exchanger H-302 and separated in a liquid 306 in separator V-301 and pumped back as liquid reflux 307 on column C-301 with pump P-301.

The vapor product 309 from separator V-301 can be sent directly to the conversion process as hydrocarbon feedstock stream 332 similar to lighter hydrocarbon feedstock stream 331, where there is a slight advantage to keep the heavier hydrocarbon feedstock stream 332 separate to crack them under different conditions. It can be advantageous for example to steam crack the lighter hydrocarbon feedstock stream 331 under more severe conditions than heavier hydrocarbon feedstock stream 332, because of the lighter components in hydrocarbon feedstock stream 331. It is also possible to fully or partly mix the hydrocarbon feedstock 331, 332 streams to make better use of the energy capacity in the conversion process.

It is also possible to produce a liquid naphtha. For this the water from lighter naphtha stream 310 can be condensed out in condenser H-303 into stream 311. Because of the higher pressure this system is operated at a higher pressure compared to conventional crude distillers, the temperature is higher (in the range of 130–180° C.), releasing more valuable heat which is worth recovering then in a traditional crude distiller (<100° C.). Vaporization unit V-302 separates stream 311 in a sour water fraction 313 that together with the sour water from V-301 in stream 308 is sent for treatment, an unstable(ized) naphtha fraction 312 which can be pumped by P-303 to a naphtha stabilizer column and an LPG fraction 333 can be sent to a gas plant or fuel gas network.

The bottom product in stream 314 from medium pressure distillation column C-301 is further heated to a temperature in the range of 320-360° C. by heat exchanger H-304 and added to atmospheric distillation column C-302 together with low pressure steam 343 or low pressure stripping steam. Low pressure steam normally has an absolute pressure in a range of 0.1-0.7 MPa. Atmospheric distillation column C-302 operates at an absolute pressure below 0.6 MPa and above atmospheric pressure (0.1 MPa). Atmospheric distillation column C-302 produces a middle distillate fraction 316 at the top. Vapors from distillate collection vessel V-303 are sent to decanter V-304, where they are condensed by condenser H-305. Decanter V-304 separates this in a vapor fraction 326 to be sent to a gas treatment plant, and sour water 328 to be sent for treatment together with other sour water streams 313, 308. The liquid fraction 324 is pumped by pump P-305 to the medium pressure distillation column C-301 via stream 325 as described.

The bottom product 321 of atmospheric distillation column C-302 in stream 321 is treated by a conventional vacuum distillation column C-303 as common in crude distillation units (not all equipment is shown) to produce middle distillate vapors 337, and light vacuum gas oil, heavy vacuum gas oil and vacuum residue 340.

From the distillation column C-302, volatile components are separated in distillate collection vessel V-303, and supplied 324 via condenser H-306 and decanter V-304, and pressurized P-305 via stream 325 to the medium pressure distillation column C-301.

Thus most of the volatile components of the hydrocarbon feedstock can be retained in the hydrocarbon feedstock vapor for processing in the conversion process at medium pressure as described.

All the above is to ensure that the conversion process can process a pressurized, vaporized naphtha/hydrocarbon feedstock stream in a conversion process as shown in FIG. 2.

Hydrocrackers and FCC units typically have a main fractionator column, which can be replaced by medium pressure distillation columns C-301 and atmospheric distillation column C-302 with all their associated equipment to also provide pressurized, vaporized hydrocarbon feedstock to a conversion process as shown in FIG. 2.

FIG. 2 shows an application of the process and system for producing hydrocarbon feedstock vapor. Crude hydrocarbon feedstock 201, i.e. crude oil, is supplied to the process 300, where hydrocarbon feedstock is produced. The hydrocarbon feedstock vapor 331 is supplied to a hydrocarbon vapor inlet 203 of the conversion process for producing derivative components 205. As vaporizing hydrocarbon feedstock is no longer required, the conversion process can be performed more efficiently.

REFERENCE NUMERALS

300 process and system for producing hydrocarbon feedstock vapor
301 crude oil
302 heated crude
303 naphtha distillate
304 naphtha part for condensing and reflux
305 heated naphtha part for condensing and reflux
306 liquid
307 reflux
308, 313, 334 sour water
309 vapor product
310 lighter naphtha stream
311 condensed water stream
312, 335 liquid naphtha
314 heavier fractions
315 heated heavier fractions
316 middle distillate fraction
317 gas components
325 liquid middle distillate
328 sour water
331 naphtha
332 light naphtha
333, 326 liquid petroleum gas

336 middle distillates, kerosene, diesel
337 middle distillate vapors
340 vacuum residue
342 medium pressure stripping steam
343 low pressure steam
C-301 medium pressure distillation column
C-302 atmospheric distillation column
C-303 conventional vacuum distillation column
H-301 heat exchanger
H-302 heat exchanger
H-303 condenser
H-305 condenser
P-303 pump
P-305 pump
V-301 vaporization unit
V-302 vaporization unit
V-303 distillate collection vessel
V-304 decanter
200 process for producing hydrocarbon feedstock derivatives
300 process for producing hydrocarbon feedstock vapor
204 hydrocarbon conversion process
203 hydrocarbon feedstock inlet
205 hydrocarbon feedstock derivatives

The invention claimed is:

1. A process for producing hydrocarbon feedstock vapor comprising pressurizing hydrocarbon feedstock using a hydrocarbon feedstock pump;

preheating the pressurized hydrocarbon feedstock in a first heat exchanger; and distilling the preheated hydrocarbon feedstock in a medium pressure distillation column connected to the first heat exchanger using medium pressure stripping steam having an absolute pressure in a range of 0.8-2.0 MPa and a temperature of 350° C., into at least one of a light distillate fraction and a middle distillate fraction and a heavy distillate fraction;

preheating fluid components of the hydrocarbon feedstock from the medium pressure distillation column through heat exchange in a second heat exchanger;

wherein the low pressure distillation column is arranged to operate at atmospheric pressure;

recycling condensed components of the distillated hydrocarbon feedstock from the low pressure distillation column to the medium pressure distillation column wherein the first heat exchanger is heated using a heat transfer medium having a temperature in a range of 160-350° C.

2. A process according to claim 1, further comprising distilling the hydrocarbon feedstock in the medium pressure distillation column using medium pressure stripping steam having an absolute pressure 0.8 2.0 MPa.

3. A process according to claim 1, wherein the heat exchanger is heated using a heat transfer medium having a temperature in a range of 350° C.

4. A process according to claim 1, further comprising distilling the hydrocarbon stream in a low pressure distillation column using low pressure stripping steam having an absolute pressure of 0.1 MPa.

5. A process according to claim 1, further comprising distilling the hydrocarbon stream in a low pressure distillation column using low pressure stripping steam having an absolute pressure in a range of 0.1-0.7 MPa.

6. A process according to claim 4, further comprising recycling condensed components of the distillated hydrocarbon feedstock from the low pressure distillation column to the medium pressure distillation column.

7. A process according to claim 2, wherein the medium pressure stripping steam has a temperature in a range of 180-350° C.

8. A process according to claim 2, wherein the heat exchanger is heated using a heat transfer medium having a temperature in a range of 160-350° C.

9. A process for producing hydrocarbon feedstock vapor consisting of the steps of:

pressurizing hydrocarbon feedstock using a hydrocarbon feedstock pump;

preheating the pressurized hydrocarbon feedstock in a first heat exchanger;

distilling the preheated hydrocarbon feedstock in a medium pressure distillation column connected to the first heat exchanger using medium pressure stripping steam having an absolute pressure in a range of 2.0 MPa, wherein the medium pressure stripping steam has a temperature of 350° C. and an absolute pressure in a range of 0.1-0.7 MPa, wherein the medium pressure distillation column is operated at an absolute pressure in a range of 0.7 to 1.2 MPa and wherein the heat exchanger is heated using a heat transfer medium having a temperature of 350° C.;

preheating fluid components of the hydrocarbon feedstock from the medium pressure distillation column through heat exchange in a second heat exchanger;

wherein the medium pressure distillation yields at least one of a light distillate fraction and a middle distillate fraction and a heavy distillate fraction, wherein the low pressure distillation column is arranged to operate at atmospheric pressure;

recycling condensed components of the distillated hydrocarbon feedstock from the low pressure distillation column to the medium pressure distillation column.

10. A process according to claim 1, wherein the heat exchanger is heated using a heat transfer medium having a temperature of 350° C.

* * * * *